US008160472B2

(12) United States Patent
Tomatsu

(10) Patent No.: US 8,160,472 B2
(45) Date of Patent: Apr. 17, 2012

(54) IMAGE FORMING DEVICE HAVING A STRUCTURE CAPABLE OF FACILITATING POSITIONING OF AN IMAGE FORMING UNIT PROVIDED IN THE IMAGE FORMING DEVICE

(75) Inventor: Yoshiya Tomatsu, Kasugai (JP)

(73) Assignee: Brother Kogyo Kabsuhiki Kaisha, Aichi-ken (JP)

( * ) Notice: Subject to any disclaimer, the term of this patent is extended or adjusted under 35 U.S.C. 154(b) by 515 days.

(21) Appl. No.: 12/405,719

(22) Filed: Mar. 17, 2009

(65) Prior Publication Data

US 2009/0317126 A1 Dec. 24, 2009

(30) Foreign Application Priority Data

Jun. 19, 2008 (JP) ..... 2008-160741

(51) Int. Cl.
*G03G 15/00* (2006.01)

(52) U.S. Cl. ..... 399/107; 399/111

(58) Field of Classification Search ..... 399/107, 399/111, 110; 292/137, 163, 175, 145, 340, 292/341.15, DIG. 11, 11, 27, 49, 95, 111, 292/98, 194, 197, 198
See application file for complete search history.

(56) References Cited

U.S. PATENT DOCUMENTS 1,872,321 A * 8/1932 Moore ..... 292/111
2,470,591 A * 5/1949 Viola et al. ..... 292/163
4,833,547 A * 5/1989 Mase ..... 292/111
5,047,803 A * 9/1991 Kanoto ..... 399/111
5,285,240 A * 2/1994 Kinoshita et al. ..... 399/110
5,608,498 A 3/1997 Nagase et al.
5,764,477 A * 6/1998 Ohgami et al. ..... 292/163
5,774,766 A 6/1998 Karakama et al.
6,453,135 B1 9/2002 Sameshima et al.
6,550,838 B2 * 4/2003 Bobbitt et al. ..... 292/341.15
6,941,093 B2 9/2005 Park et al.
7,065,312 B2 * 6/2006 Sasoh et al. ..... 399/107
7,197,262 B2 3/2007 Itabashi
(Continued)

FOREIGN PATENT DOCUMENTS

EP 2 136 268 A2 12/2009
(Continued)

OTHER PUBLICATIONS

Chinese Official Action mailed Dec. 1, 2010 in corresponding Chinese Patent Application No. 200910130546.8, together with an English language translation.

(Continued)

*Primary Examiner* — Susan Lee
(74) *Attorney, Agent, or Firm* — Scully, Scott, Murphy & Presser, PC

(57) ABSTRACT

An image forming device having a frame, a door, and a movable image forming unit to be assembled in the frame when the door is open. Positioning of the image forming unit relative to the frame and a closing position of the door are maintainable when the door is closed. When the door is closed, a hook at the door side is engaged with a hook of a lock unit at the frame side. The lock unit is movable in association with the movement of the door to its closed position to move a pressure portion, so that a part of the image forming unit is pressed by the pressure portion for positioning.

11 Claims, 7 Drawing Sheets

U.S. PATENT DOCUMENTS

| | | | | |
|---|---|---|---|---|
| 7,266,327 | B2 | 9/2007 | Mori et al. | |
| 7,330,679 | B2 | 2/2008 | Kweon | |
| 7,428,386 | B2 | 9/2008 | Itabashi | |
| 7,474,863 | B2 * | 1/2009 | Kaiga | 399/111 |
| 7,720,408 | B2 | 5/2010 | Ueno et al. | |
| 8,010,013 | B2 * | 8/2011 | Tomatsu | 399/110 |
| 2005/0019058 | A1 * | 1/2005 | Hirose et al. | 399/110 |
| 2006/0159486 | A1 | 7/2006 | Kweon | |
| 2006/0197827 | A1 * | 9/2006 | Tokuzaki | |
| 2006/0236612 | A1 * | 10/2006 | Sheng et al. | 399/107 |
| 2007/0046039 | A1 * | 3/2007 | Kraenzle | 292/341.15 |
| 2007/0071494 | A1 | 3/2007 | Igarashi et al. | |
| 2007/0110472 | A1 * | 5/2007 | Ikebata | 399/110 |
| 2007/0147885 | A1 | 6/2007 | Okabe et al. | |
| 2007/0160380 | A1 | 7/2007 | Imaizumi et al. | |
| 2007/0160384 | A1 | 7/2007 | Sakurai et al. | |
| 2007/0160385 | A1 | 7/2007 | Noguchi et al. | |
| 2007/0160386 | A1 | 7/2007 | Kawamura | |
| 2007/0160388 | A1 | 7/2007 | Yoshimura et al. | |

FOREIGN PATENT DOCUMENTS

| | | | |
|---|---|---|---|
| JP | 8-220824 | | 8/1996 |
| JP | 9-16056 | | 1/1997 |
| JP | 9-281840 | | 10/1997 |
| JP | 11-202725 | | 7/1999 |
| JP | 2000-181329 | | 6/2000 |
| JP | 2001-142378 | | 5/2001 |
| JP | 2002-162797 | | 6/2002 |
| JP | 2002162797 | A * | 6/2002 |
| JP | 2004-46185 | A | 2/2004 |
| JP | 2005-157113 | | 6/2005 |
| JP | 2007-121983 | | 5/2007 |
| JP | 2007-178657 | | 7/2007 |
| JP | 2007-213012 | | 8/2007 |
| JP | 2007-213018 | | 8/2007 |
| JP | 2007-213024 | | 8/2007 |
| JP | 2007-213025 | | 8/2007 |
| JP | 2007-213033 | | 8/2007 |
| JP | 2007-316367 | | 12/2007 |

OTHER PUBLICATIONS

Chinese Office Action dated Jan. 31, 2011 together with English language translation from related U.S. Appl. No. 12/405,672.

Japanese Official Action dated Apr. 20, 2010 together with English translation, PBRO3421; 2008-160742.

Japanese Official Action dated Apr. 20, 2010 together with English translation, PBRO3420, 2008-160741.

Notice of Allowance dated Apr. 29, 2011 from related U.S. Appl. No. 12/405,672.

Extended European Search Report dated Aug. 23, 2010.

Extended European Search Report dated Oct. 26, 2010.

Japanese Official Action dated Nov. 24, 2010 with partial English translation.

* cited by examiner 212
516
211a
510
511
512
352
513a
513
211
513b
517
530
500
540
211c
400
520
521
420
241
330
100
220
213
230
210
200
530
543
523
540
B
510
352
502
255
410
250
500
252
251
251
251
253

100
200
210
213
220
230
251
330
241
212
215
520
530
500
501
502
214
410
255
250
420
300
351
350
400
510
352
C
211a
TOP
BOTTOM
LEFT
RIGHT
FRONT
REAR
211b
211c
512
211
511

212
211b
513a
516
350
510
511
512
420
400
211a
540
500
517
513b
513
352
211
410
502
510
D
352
540
523
543
530
520
500
521
241
330
220
213
230
210
200
100
255
250
252
251
251
251
253

IMAGE FORMING DEVICE HAVING A STRUCTURE CAPABLE OF FACILITATING POSITIONING OF AN IMAGE FORMING UNIT PROVIDED IN THE IMAGE FORMING DEVICE

CROSS REFERENCE TO RELATED APPLICATION

This application claims priority from Japanese Patent Application No. 2008-160741 filed Jun. 19, 2008. The entire content of the priority application is incorporated herein by reference.

TECHNICAL FIELD

The present invention relates to an image forming device having an image forming system for forming an image on a recording medium. More specifically, the present invention relates to an image forming device having an image forming unit detachably supported by a frame, the image forming unit being a major part of the image forming system.

BACKGROUND

In a conventional image forming device, it is proposed that an image forming system is supported to a frame, and an image forming unit which is a part of the image forming system is detachably mounted on the frame. For example, with regard to a color laser printer having four developing cartridges corresponding to each color of black, yellow, magenta, and cyan, proposal has been made that developing cartridges and photosensitive drums are detachably mounted on a frame as an integral image forming unit. In this case, improved maintenance efficiency can be obtained because four developing cartridges can be integrally removed from a frame.

Japanese laid open patent application publication No. 8-220824 discloses an image forming device in which a door is open when removing and inserting an image forming unit, and movement of the door is interlocked with a support assembly that supports the image forming unit so that the image forming unit is positioned at a prescribed location in the image forming device in response to closure of the door.

However, in the image forming device described above, the image forming unit may be displaced from the prescribed location when the door is open. Accordingly, a lock mechanism is required for maintaining the door in a closed state during image forming operation. However, as described above, the number of parts and components to provide such mechanism increases and configuration of the device becomes more complex if a mechanism for positioning an image forming unit and the above lock mechanism are provided in association with the door.

SUMMARY

It is therefore an object of the present invention to provide an image forming device having a simple construction capable of facilitating positioning of an image forming unit supported by a frame and detachable from the frame when a door is open, and capable of maintaining a closed state of the door after the image forming unit is inserted into the frame.

This and other objects of the present invention will be attained by providing an image forming device including a frame, an image forming unit, a door, a lock unit, and a pressure portion. The frame has a first positioning part. The image forming unit is detachably supported to the frame and has a second positioning part abuttable on the first positioning part for positioning the image forming unit relative to the frame. The door is movable between an open position and a closed position relative to the frame. The image forming unit is detachable from or attachable to the frame at the open position. The lock unit is lockingly engageable with the door at the closed position of the door for maintaining the closed position. The pressure portion is provided at the lock unit and is configured to urge the image forming unit so as to press the second positioning part onto the first positioning part at the closed position of the door.

DETAILED DESCRIPTION

Next, a laser printer as an image forming device according to one embodiment of the present invention will be described with reference to FIGS. 1(A) to 7(B). The laser printer 100 includes a main frame 200 and an image forming system 300. The main frame 200 is formed substantially in a box shape. An outer cover (not shown) formed of resin is formed over an outer surface of the main frame 200. The image forming system 300 includes an image forming unit 350 capable of being pulled out of the main frame 200 and detachably mounted on the main frame 200.

Figure 2A:
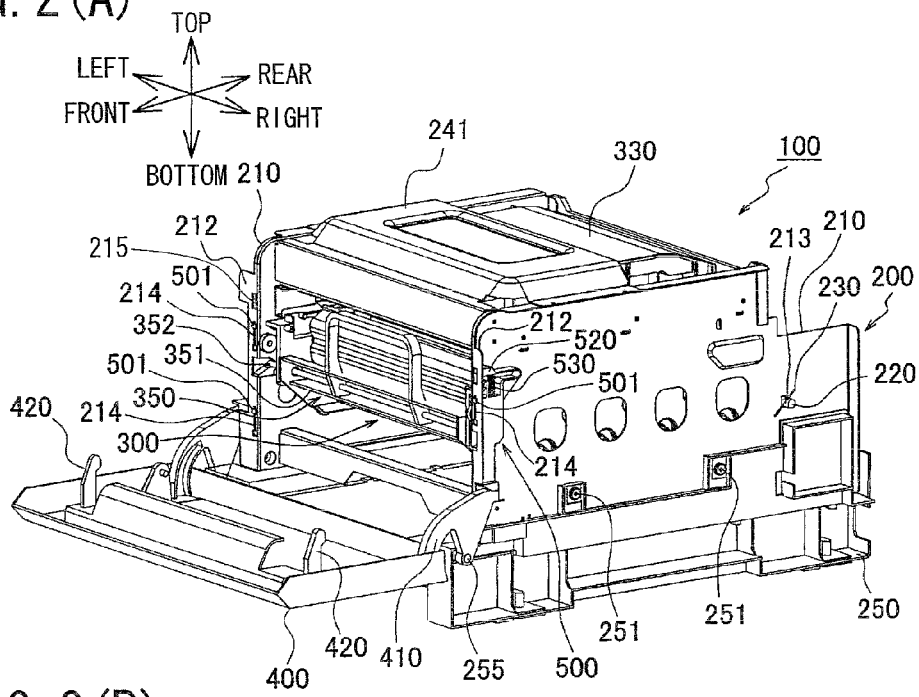
FIG. 2(A) is a perspective view of the laser printer in which the door is open, as viewed from the upper right front side of the printer according to the embodiment.
Figure 2B:
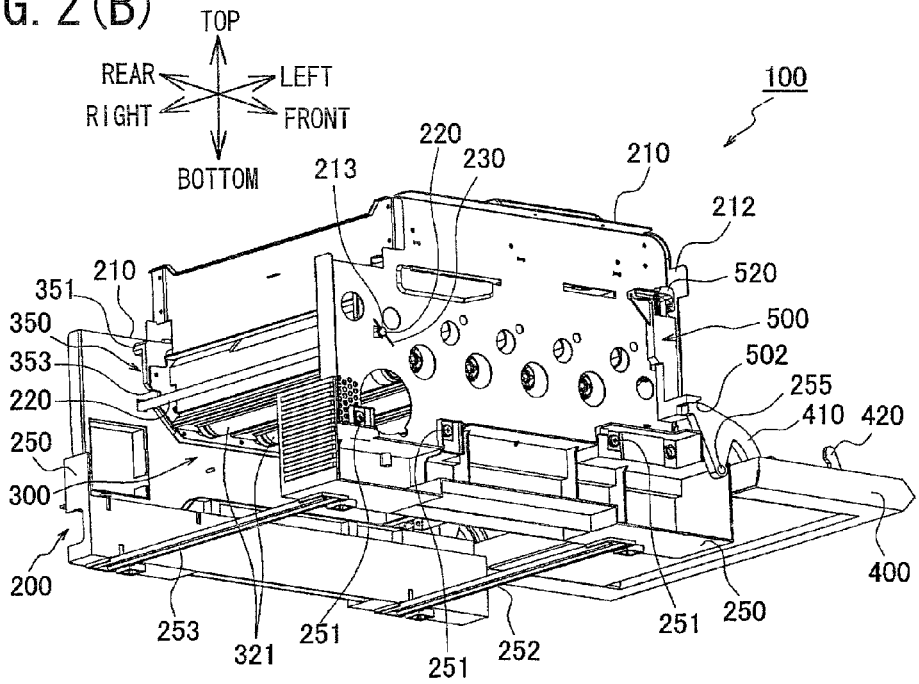
FIG. 2(B) is a perspective view of the laser printer in which the door is open as viewed from the lower left rear side of the printer according to the embodiment.
Figure 3:
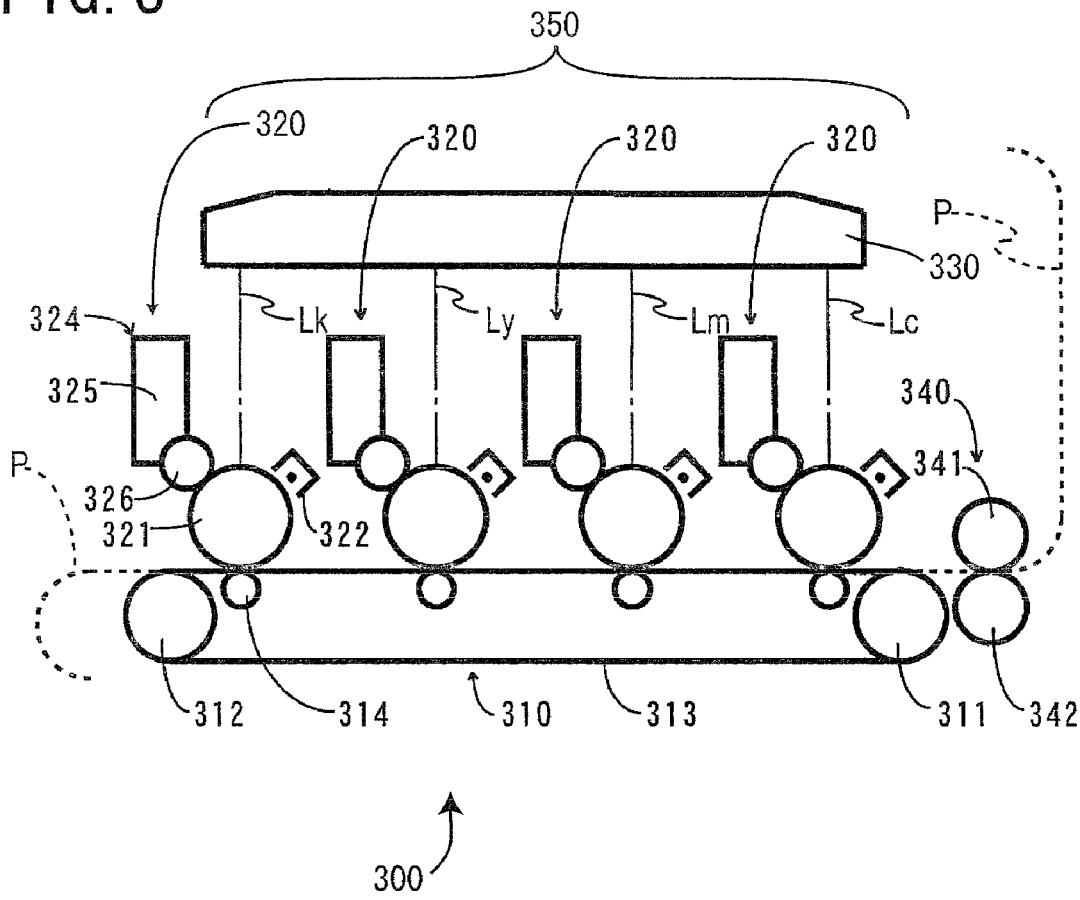
FIG. 3 is a schematic view showing a structure of an image forming system in the laser printer according to the embodiment.

The image forming system 300 includes a belt unit 310 (a conveyer unit), a scanner unit 330, a fixing unit 340, and an image forming unit 350 including four process units 320 and a drum sub unit 351 (FIGS. 2(A) and 2(B)). The belt unit 310 includes a drive roller 311, a driven roller 312, and an endless conveying belt (transfer belt) 313 stretched around the drive roller 311 and the driven roller 312, and four transfer rollers 314. The process units 320 constitute a direct transfer tandem type color image forming system. The process units 320 are disposed above the belt unit 310, and juxtaposed in the front-to-rear direction in order of the colors black (K), yellow (Y), magenta (M), and cyan (C) from the front side of the laser printer 100. Each of the process units 320 is detachably stored in each of four storages (not shown) provided in the drum sub unit 351 constituting a frame of the image forming unit 350.

Each of the process units 320 includes a photosensitive drum 321 (an image bearing member), a scorotron charger 322, and a developing cartridge 324, and a developing roller 326. The photosensitive drum 321 includes a grounded drum body formed of metal, and a positively chargeable photosensitive layer formed of polycarbonate formed on an outer surface of the drum body.

The scorotron charger 322 is disposed diagonally above and rearward of the photosensitive drum 321 and opposes the photosensitive drum 321 at a prescribed distance so as not to contact the same. The scorotron charger 322 has a charging wire formed of tungsten to generate corona discharge so that the surface of the photosensitive drum 321 can be uniformly charged to have a positive polarity.

Each of the developing cartridges 324 defines therein a toner chamber 325 in which a positively chargeable, nonmagnetic, single-component toner in one of the colors black, cyan, magenta and yellow as a developing agent is retained. The developing roller 326 is provided between the photosensitive drum 321 and the toner chamber 325 for supplying toner positively tribocharged to the photosensitive drum 321.

The transfer rollers 314 are respectively disposed opposite to the photosensitive drums 321. The conveying belt 313 is pinched between the transfer rollers 314 and the photosensitive drums 321. The conveying belt 313 moves circularly in a clockwise direction the same as the direction that the drive roller 311 rotates. A sheet supply tray (not shown) is provided in a lower section of the main frame 200. A sheet P as a recording medium is supplied to a surface of the conveying belt 313 by a supply roller (not shown) from the sheet supply tray. The sheet P on the conveying belt 313 moves past the photosensitive drums 321 and is conveyed to the rear side of the laser printer 100.

The scanner unit 330 is disposed above the process units 320. The scanner unit 330 includes a semiconductor laser (not shown) adapted for generating laser beams Lk, Ly, Lm, and Lc corresponding to image data of each color, and a polygon mirror (not shown) deflecting a laser beam L for scanning over the photosensitive drums 321 and exposes the same to the laser beam. The surface of each photosensitive drum 321 is uniformly charged to have a positive polarity by the scorotron charger 322 when rotating. Then, the surface is subjected to high speed scan of the laser beam L, so that an electrostatic latent image corresponding to an image to be formed on the sheet P is formed on the surface. Subsequently, rotation of the developing roller 326 allows the positively charged toner retained in the toner chamber 325 to be supplied to the photosensitive drum 321. Therefore, a visible toner image corresponding to the electrostatic latent image can be formed on the surface of the photosensitive drum 321. In other words, toner is deposited only at the beam-irradiated regions of the surface of the photosensitive drum 321.

The toner images formed on the surfaces of the photosensitive drums 321 are sequentially transferred onto the sheet P by a transfer bias with a negative polarity applied to the transfer rollers 314 by a constant current control, each time the sheet P conveyed on the conveying belt 313 passes between each photosensitive drum 321 and each transfer roller 314. The sheet P bearing the toner image is then conveyed to the fixing unit 340 disposed rearward of the belt unit 310.

The fixing unit 340 includes a heat roller 341 and a pressure roller 342. The heat roller 341 is drivingly rotatable and includes a heat source such as a halogen lamp. The pressure roller 342 is disposed below the heat roller 341 and opposes the heat roller 341 to press the same. The pressure roller 342 rotates in association with rotation of the heat roller 341. In the fixing unit 340, the sheet P on which the toner image with the four colors is formed is heated while conveyed between the heat roller 341 and the pressure roller 342, so that the toner image is thermally fixed on the sheet P. The sheet P on which the toner image has been fixed is conveyed by several rollers (not shown) and discharged to a discharge tray (not shown) provided in a top surface of the laser printer 100.

As described above, the drum sub unit 351 constitutes the image forming unit 350, and is adapted to retain four process units 320. The drum sub unit 351 retaining the four process units 320 is detachably installable to the main frame 200 as a detachable image forming unit 350.

Figure 4A:
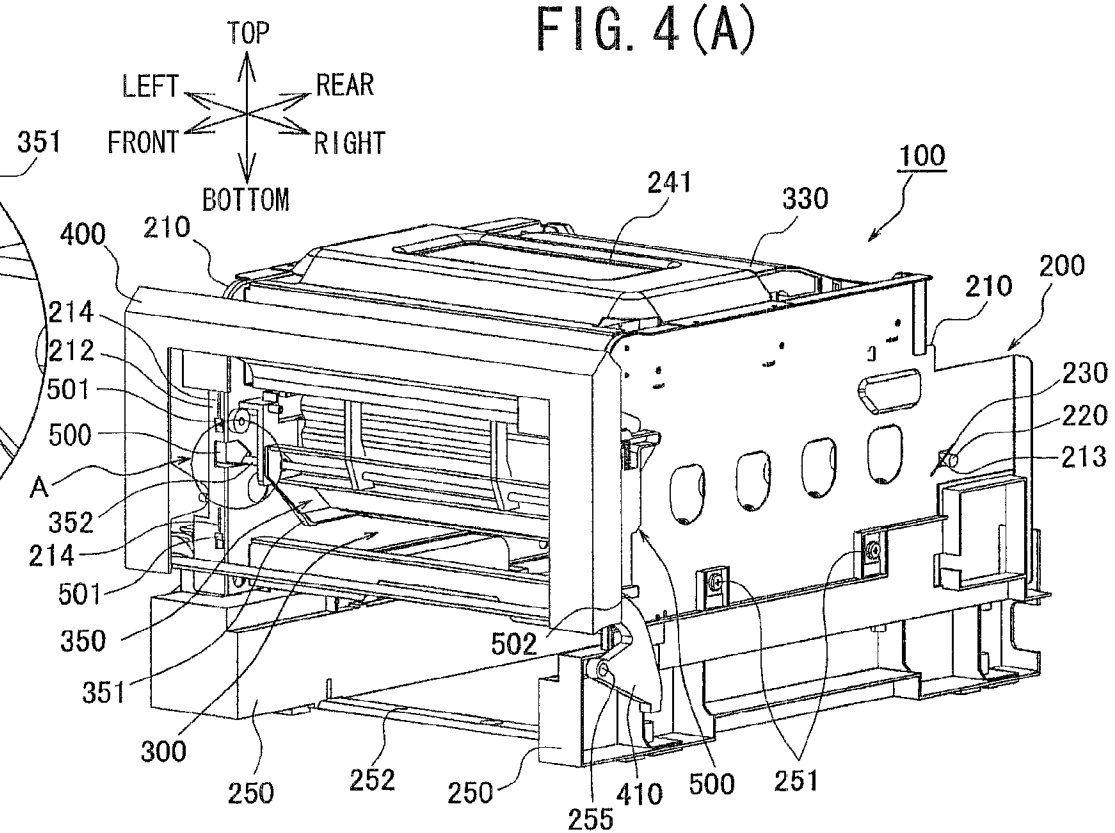
FIG. 4(A) is a perspective view showing an internal structure of the laser printer according to the embodiment as viewed from a direction the same as that in FIG. 1(A), but a part of the door is omitted for simplicity.
Figure 4B:
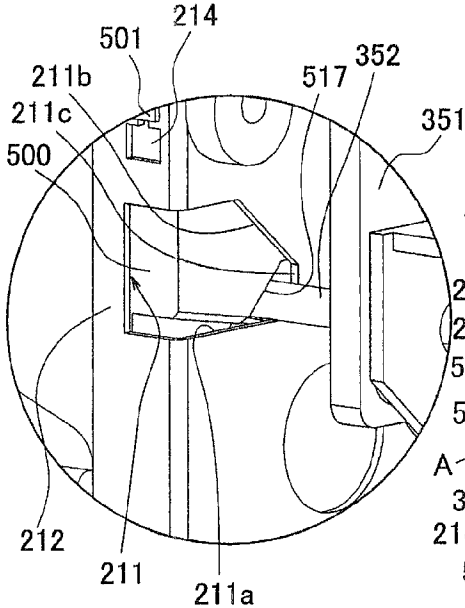
FIG. 4(B) is an enlarged view of a portion A marked by a circle A of FIG. 4(A)
Figure 5:
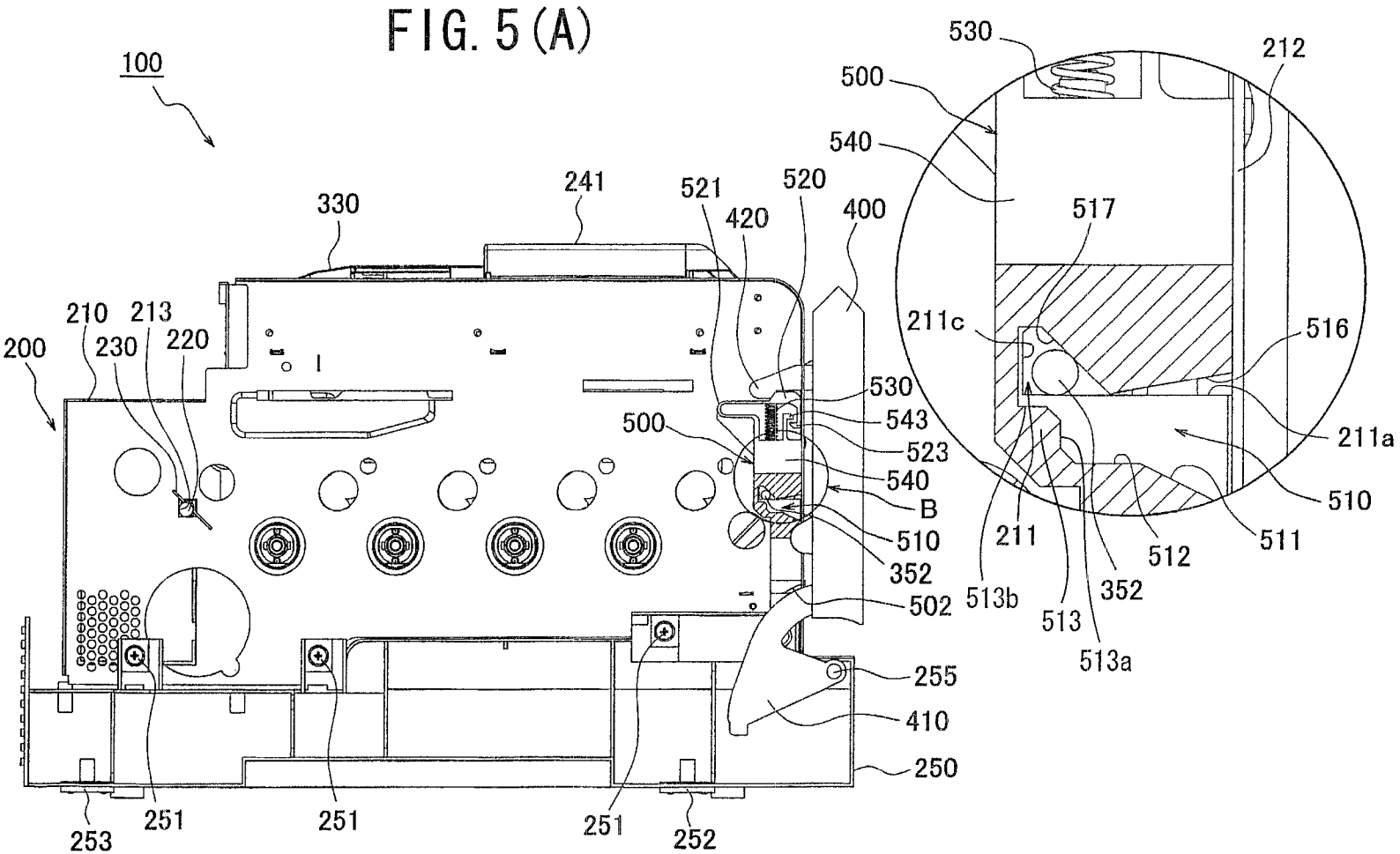
FIG. 5(A) is a left side view showing a structure of the laser printer when the door is closed according to the embodiment.
FIG. 5(B) is an enlarged view of a portion B marked by a circle B of FIG. 5(A)

As shown in FIG. 4(A), the drum sub unit 351 has a front side provided with a support shaft 352 extending along a front frame section of the drum sub unit 351 in a right-to-left direction (lateral direction). Each end of the support shaft 352 laterally outwardly protrudes from right and left side frame sections of the drum sub unit 351. The support shaft 352 functions as a second positioning part.

Figure 1A:
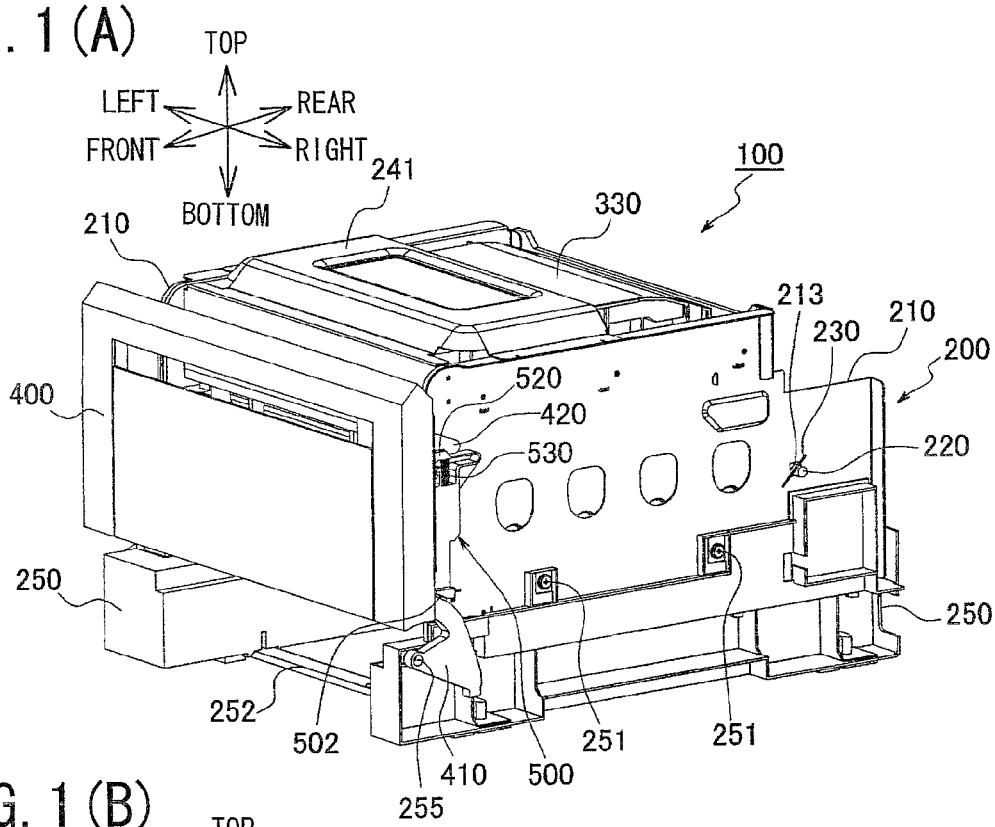
FIG. 1(A) is a perspective view of a laser printer in which a door is closed as viewed from an upper right front side of the printer according to one embodiment of the present invention.
Figure 1B:
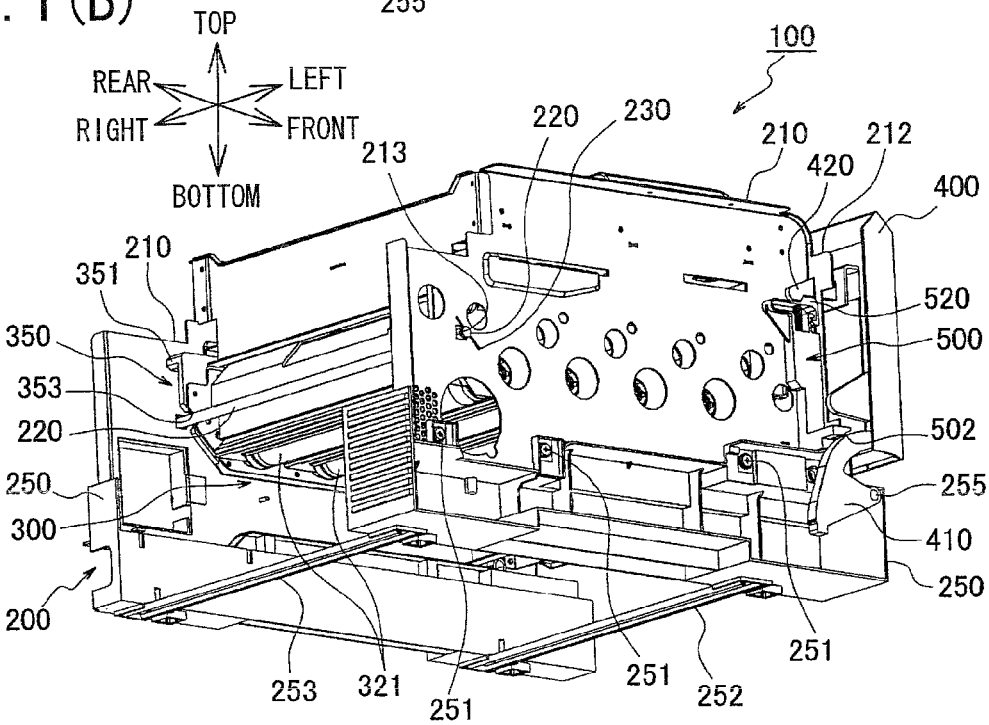
FIG. 1(B) is a perspective view of the laser printer in which the door is closed as viewed from a lower left rear side of the printer according to the embodiment.

As shown in FIGS. 1(B) and 2(B), the right and left side frame sections of the drum sub unit 351 has rear end portions formed with cutout parts 353. Each cutout part 353 is open at a rear end face of each side frame section, and extends frontward.

Incidentally, with regard to some parts of the laser printer 100 described later, either one of the left side or the right side may be shown in the drawings. However, it should be understood that most parts of the laser printer 100 are configured symmetrically.

Next, a structure of the main frame 200 will be described. The main frame 200 includes a pair of metal frames 210, and a pair of resin frames 250 positioned immediately below the pair of metal frames 210 for supporting the same. The pair of metal frames 210 is adapted for supporting the scanner unit 330 and the image forming unit 350. The scanner unit 330 has a scanner plate (not shown) fixed by screws on an upper portion of the metal frames 210. Thus, the scanner unit 330 can be supported horizontally in the upper portion of the metal frames 210.

Each lower edge of the metal frames 210 is in contact with each upper edge of the resin frames 250. Each of the resin frames 250 has a laterally outward portion protruding laterally outward of the metal frames 210, and the laterally outward portion is fixed to the metal frames 210 by screws 251. A front beam 252 is fixed by screws to bottom surfaces of the resin frames 250 at a front side thereof. A rear beam 253 is fixed by screws to the bottom surfaces of the resin frames 250 at a rear side thereof. The resin frames 250 are connected each other by the front beam 252 and the rear beam 253.

Each side frame section of the main frame 200 has a front end formed with a hole 211 allowing the support shaft 352 to extend therethrough. When the image forming unit 350 is mounted on the main frame 200, each end of the support shaft 352 is brought into engagement with each hole 211. More specifically, each front portion of each side frame section is bent laterally outward so as to form a flange 212, and the hole 211 is formed in the flange 212 to form an L-shape. That is, the hole 211 has a front opening and extends rearward. The hole 211 defines a lower surface 211*a* extending horizontally and rearward. Each end portion of the support shaft 352 is placed on the lower surfaces 211*a* so that the front end of the image forming unit 350 is subjected to positioning in a vertical direction. The lower surface 211*a* functions as a first positioning part or as an end face. The hole 211 also defines an upper slant surface 211*b* (a second shift portion) extending diagonally rearward and downward, and a rear surface 211*c* extending vertically.

A reference shaft 220 bridges between the pair of metal frames 210 at a rear portion thereof, so that the cutout parts 353 is engageable with the reference shaft 220 when the image forming unit 350 is mounted on the main frame 200. Thus, the engagement defines the position of the rear end of the image forming unit 350 in the vertical direction and in the front-to-rear direction. More specifically, each metal frame 210 is formed with a square hole 213 at a rear portion thereof, and each end portion of the reference shaft 220 extends through the square hole 213. Each end portion of the reference shaft 220 is urged by a linear spring 230 towards a lower rear corner of the square hole 213 for positioning.

The holes 211 and the square holes 213 are concurrently formed on the metal frames 210 by a press forming together with screw holes (not shown) for fixing the scanner unit 330. Further, portions of the metal frame 210 around the screw holes, the holes 211, and the square holes 213 are not bent but flat. Therefore, enhanced positional accuracy between the scanner unit 330 and the image forming unit 350 can result in the laser printer 100, and eventually, positional accuracy between the scanner unit 330 and each of the photosensitive drums 321 can be improved. Accordingly, an accurate image can be formed.

Incidentally, the drum sub unit 351 is guided by a guide (not shown) so that the reference shaft 220 can fit with the cutout parts 353 for assembly of the image forming unit 350 into the main frame 200. Such a guide structure is disclosed in laid open Japanese patent application publication No. 2007-121983. Accordingly, a detailed explanation will be omitted.

Further, an upper end portion of each metal frame 210 is orthogonally bent outward. A scanner cover 241 formed of metal and covering an upper front half portion of the scanner unit 330 is fixed to the upper end portion by screws. The belt unit 310 described above is detachably mounted between the pair of resin frames 250.

A door 400 is pivotably movable between a vertical closed position for closing a front space defined between the pair of metal frames 210 and a horizontal open position for exposing the image forming unit 350 to an atmosphere through the pair of metal frames 210. More specifically, the resin frame 250 has an upper front portion provided with a pivot shaft 255 protruding laterally outwardly. A generally sector-shaped eccentric cam plate 410 is attached to each pivot shaft 255 and pivotally movable about an axis thereof. The cam plate 410 has an arcuate cam surface, and has a configuration such that a radius between the arcuate cam surface and the axis of the pivot shaft 255 is gradually reduced toward the door 400. The door 400 is integrally with each of the cam plates 410 at a radially shortest end thereof. Each of the cam plates 410 is positioned rearward of the door 400 (a side of the main frame 200) when the door 400 is at its closed position. The door 400 has a hook 420 protruding from an inner surface thereof (a rear side of the door 400 when the door 400 is at its closed position).

As shown in FIG. 4(A), each flange 212 is formed with upper and lower vertically elongated slots 214 vertically aligned with each other. Each lower end portion of each slot 214 has a width greater than that of the remaining portion thereof. A lock member 500 is vertically slidably movably supported to the each flange 212. That is, each lock member 500 is positioned on a rear surface of each flange 212. The lock member 500 includes engagement portions 501 engaged with the slots 214, so that the lock member 500 is vertically slidable on the rear surface of the flange 212. The engagement portions 501 have an enlarged head positioned in front of each flange 212. For assembly of the lock member 500 to the flange 212, the head can be inserted through the greater width portion of each slot 214. The lock member 500 is made of a resin, so that its hardness is lower than that of the metal frame 210 and the support shaft 352 those made from a metal.

As best shown in FIG. 5(A), a lower end of the lock member 500 is formed with a chamfered portion 502 for providing a smooth contact with the arcuate cam surface of the cam plate 410, so that the lock member 500 can move upward and downward in association with the movement of the door 400. In other words, the lock member 500 descends when the door 400 is at its closed position as shown in FIG. 1 (A), since the chamfered portion 502 is in contact with the smaller radius portion of the cam surface. On the other hand, the lock member 500 ascends when the door 400 is at its open position as shown in FIG. 2(A), since the chamfered portion 502 is in contact with the greater radius portion of the cam surface.

As shown in FIG. 5(B), each of the lock member 500 has a recessed portion 510 at a portion superposed with the hole 211. The recessed portion 510 has a front opening and is cutout in an inner side of the lock member 500. In FIGS. 5(A) and 5(B), an outer surface of the lock member 500 is partially omitted for simplicity in order to clarify the shape of the recessed portion 510.

As shown in FIG. 5(B), the recessed portion 510 defines a lower surface and an upper surface extending rearward. As viewed from the front opening of the recessed portion 510, the lower surface has a first inclined surface 511, a horizontal flat surface 512, and a protruding part 513. The first inclined surface 511 inclines upward toward a bottom end of the recessed portion 510. The horizontal flat surface 512, functioning as a shift portion or as a restraining portion, is connected from a rear end of the first inclined surface 511. The protruding part 513 protrudes upward from the rear end of the horizontal flat surface 512 and is generally rectangular-shaped. That is, the protruding part 513 has a vertical surface 513*a* connected to the horizontal flat surface 512, and an upper surface 513*b* connected to the vertical surface 513*a*. A rear end of the upper surface 513*b* is connected to a bottom surface of the recessed portion 510.

As viewed from the front opening of the recessed portion 510, the upper surface has a second inclined surface 516 and a third inclined surface 517. The second inclined surface 516 slightly inclines downward toward the bottom of the recessed portion 510. The third inclined surface 517, functioning as a pressure portion, is connected to the rear end of the second inclined surface 516 and inclines upward toward the bottom of the recessed portion 510. Angle between the second and third inclined surfaces 516 and 517 is approximately 135 degrees.

Figures 6A, 6B:
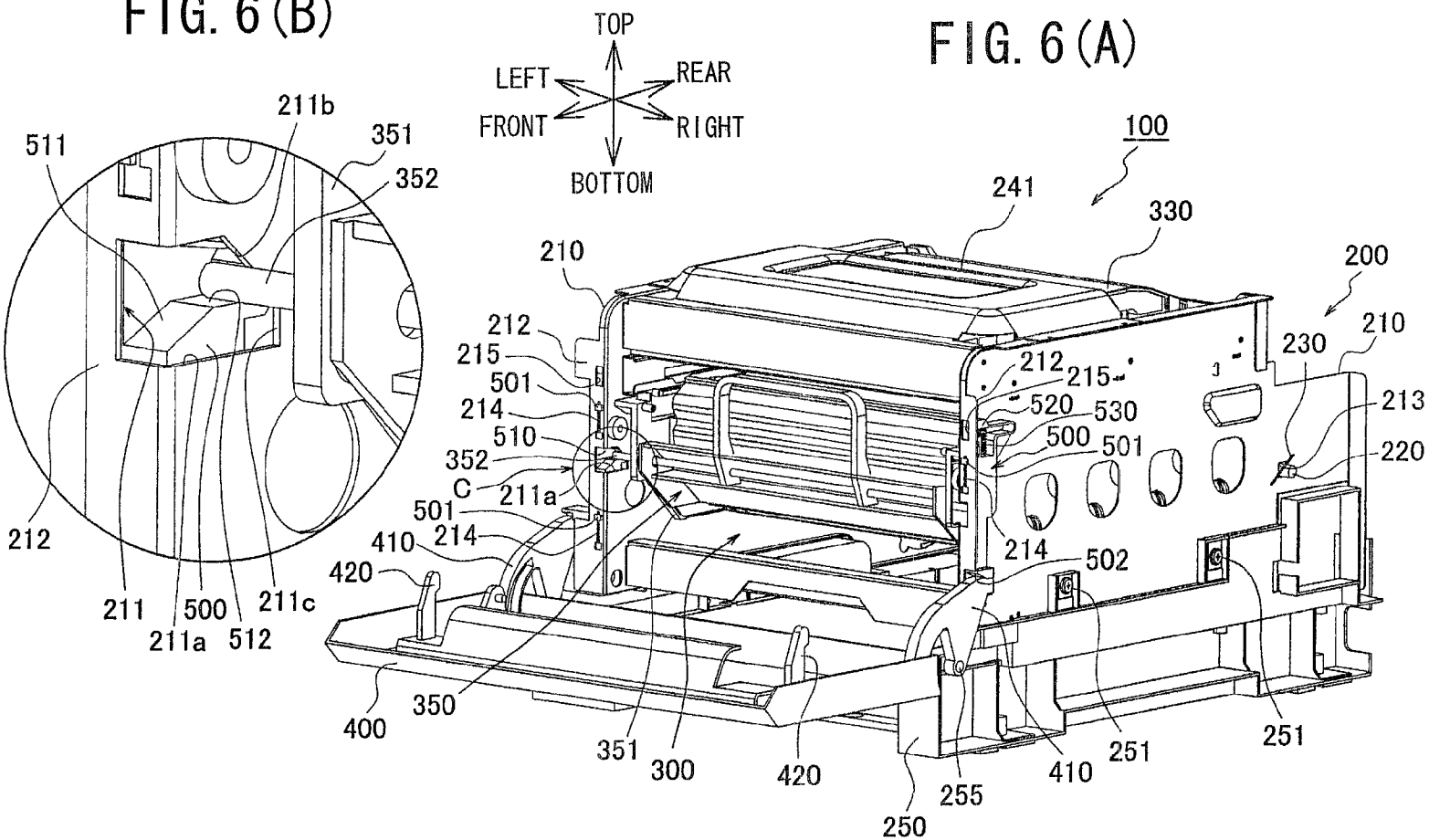
FIG. 6(A) is a perspective view showing a structure of the laser printer when the door is open as viewed from the upper right front side of the printer according to the embodiment.
FIG. 6(B) is an enlarged view of a portion C marked by a circle C of FIG. 6(A)

An upper portion of each lock member 500 has a locking hook 520 which is integrally formed with the lock member 500. The locking hook 520 is engaged with the hook 420 of the door 400 when the door 400 is at its closed position. This engagement can maintain the closing state of the door 400. The flange 212 is formed with a hole 215 allowing the hook 420 to extend therethrough as shown in FIG. 6(A). Thus, the hook 420 is engagable with the locking hook 520.

As shown in FIG. 5(A), the locking hook 520 is formed of resin and is integrally with a main body 540 of the lock member 500 via a U-shaped leaf spring plate 521. A coil spring 530 is interposed between an upper surface of the main body 540 and the locking hook 520. A first regulation hook 543 protrudes upward from the upper surface of the main body 540, and a second regulation hook 523 protrudes downward from a lower portion of the locking hook 520. The first regulation hook 543 is engageable with the second regulation hook 523 so that excessive urging of the locking hook 520 toward the hook 420 by the biasing force of the coil spring 530 can be restrained. A combination of the main body 540, the U-shaped leaf spring plate 521, the hooks 520, 523, 543 and the coil spring 530 is referred to as a lock unit.

Figures 7A, 7B:
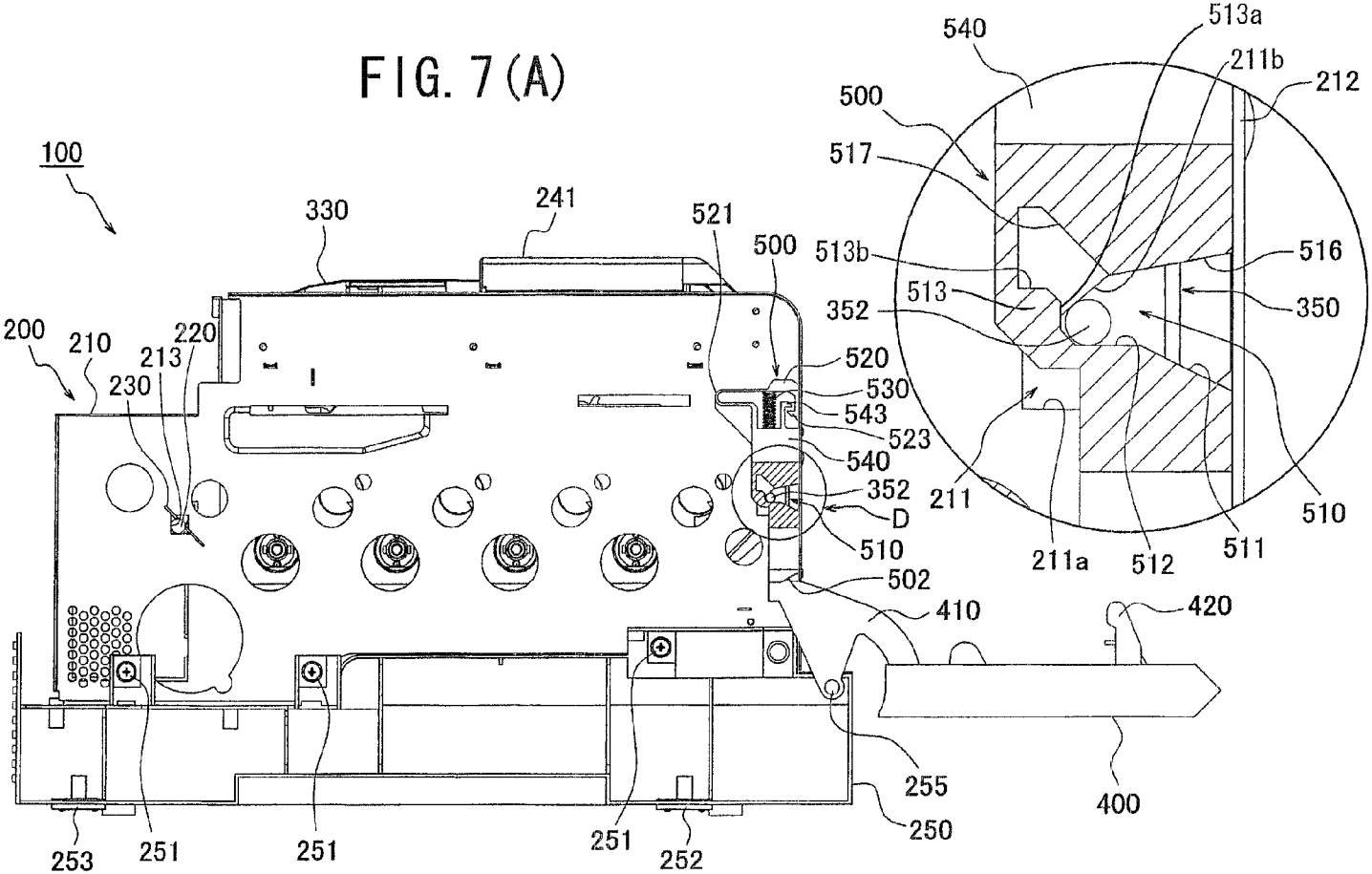
FIG. 7(A) is a left side view showing a structure of the laser printer when the door is open according to the embodiment.
FIG. 7(B) is an enlarged view of a portion D marked by a circle D of FIG. 7(A).

In FIGS. 7(A) and 7(B), the outer surface of the lock member 500 is partially omitted, in the same manner as FIGS. 5(A) and 5(B). As shown in FIGS. 6(B) and 7(B), when the door 400 is at its open position and the lock member 500 moves upward, the first inclined surface 511 and the horizontal flat surface 512 of the recessed portion 510 is moved to a position above the lower surface 211*a* of the hole 211. Further, the upper surface 513*b* of the protruding part 513 is positioned above a lower part of the upper slant surface 211*b* of the hole 211, and the first inclined surface 511 is positioned below the upper slant surface 211*b* and above the lower surface 211*a*.

When the door 400 is at its open position for detachment or attachment of the image forming unit 350 relative to the main frame 200, the support shaft 352 is not in direct contact with the lower surface 211*a* because the first inclined surface 511 and the horizontal flat surface 512 are disposed above the lower surface 211*a*, even if the image forming unit 350 is slammingly pushed into the main frame 200. Further, since the upper surface 513*b* of the protruding part 513 is disposed above the lower portion of the upper slant surface 211*b*, the support shaft 352 can be brought into contact with a lower portion of the vertical surface 513*a* of the protruding part 513, i.e., base end portion thereof. Therefore, the image forming unit 350 can be restrained from being excessively inserted into rearward. It should be noted that the cutout parts 353 are not fully engaged with the reference shaft 220 when the support shaft 352 is in contact with the base end portion of the protruding part 513. Hence, the reference shaft 220 can be restrained from being in impacting contact with the cutout parts 353 at an initial insertion phase of the image forming unit 350 into the main frame 200.

The third inclined surface 517 is positioned above the support shaft 352 if the support shaft 352 is placed on the horizontal flat surface 512. In this state, if the door 400 is moved to its closed position, the lock member 500 is moved downward and the hook 420 extends into the hole 215 and is brought into engagement with the locking hook 520. Accordingly, the third inclined surface 517 presses the support shaft 352 downward and rearward as shown in FIG. 5(B) because of the biasing force transmitted from the hook 420, the U-shaped leaf spring plate 521, the locking hook 520, and the coil spring 530. At this time, the first inclined surface 511, the horizontal flat surface 512, and the protruding part 513 are positioned below the lower surface 211*a*. Thus, the support shaft 352 is in direct contact with the lower surface 211*a* of the hole 211, and the image forming unit 350 as a whole can further be pressed rearward. Thus, the cutout parts 353 can be engaged with the reference shaft 220. Accordingly, the image forming unit 350 is positioned at a prescribed location in the main frame 200 so that an accurate image can be formed on the sheet P.

As shown in FIG. 5(B), when the door 400 is at its closed position, the support shaft 352 is not in contact with the rear surface 211*c* of the hole 211. This is because the engagement of the cutout parts 353 with the reference shaft 220 prevents the image forming unit 350 from moving rearward. Further, as shown in FIG. 5(A), when the door 400 is at its full closed position, the chamfered portion 502 of the lock member 500 is out of contact from the cam plate 410. With such structure, dimensional variation in the cam plate 410 due to production error does not affect the downward movement of the lock member 500. Thus, the support shaft 352 can be properly pressed by the third inclined surface 517 for positioning the image forming unit 350. Further, since the coil spring 530 is interposed between the locking hook 520 and the main body 540 of the lock member 500, occurrence of creep of the leaf spring plate 521 does not constitute a failure to transmit the pressing force from the hook 420 to the third inclined surface 517.

When the door 400 is moved to the open position as shown in FIGS. 7(A) and 7(B) from the closed position shown in FIG. 5(A), the lower surface 211*a* is moved to a position below the upper surface 513*b*, so that the support shaft 352 will be transferred from the lower surface 211*a* to the upper surface 513*b*. In accordance with the further upward movement of the lock member 500, the support shaft 352 is rolled down onto the horizontal flat surface 512 from the upper surface 513*b* of the protruding part 513 because of the urging force from the upper slant surface 211*b*. Since the lock member 500 is moved upward, the support shaft 352 on the horizontal flat surface 512 is lifted above the lower surface 211*a* of the hole 211.

As a result, the image forming unit 350 is moved frontward by a length of the upper surface 513*b*, and is moved upward by a vertical distance between the lower surface 211*a* and the horizontal flat surface 512 as shown in FIG. 7(B). This frontward and upward movement facilitates removal of the image forming unit 350. Since the front end of the image forming unit 350 is lifted up, the photosensitive drums 321 are moved away from the conveying belt 313. Incidentally, a guide mechanism described in laid open Japanese patent application publication No. 2007-121983 can be provided in the laser printer 100 for positively moving the image forming unit 350 upward when the image forming unit 350 is being pulled out frontward. In the latter case, the photosensitive drums 321 can surely be moved away from the conveying belt 313.

In the laser printer 100 according to the above-described embodiment, the third inclined surface 517 is provided in the lock member 500 formed integrally with the locking hook 520 for maintaining the door 400 in a closed state. The structure of the laser printer 100 can be simplified by reducing the number of parts and components, and eventually, cost reduction for manufacturing the laser printer 100 can be attained.

In the present embodiment, engagement between the support shaft 352 and the lower surface 211*a* of the hole 211 formed on the metal frame 210 can provide positioning of the image forming unit 350. Further, the support shaft 352 is directly pressed by the third inclined surface 517. The image forming unit 350 can be subjected to proper positioning relative to the main frame 200. Accordingly, the laser printer 100 in the present embodiment is capable of forming an accurate image on the sheet P.

Further, in the laser printer 100, the protruding part 513 and the horizontal flat surface 512 integrally formed in the lock member 500 facilitates separation of the photosensitive drums 321 from the conveying belt 313 when the door 400 is at its open position. Hence, the photosensitive drums 321 can be protected against any scratch or injury because no frictional contact with the conveyer belt 313 during detachment work of the image forming unit 350.

In the laser printer 100 according to the above-described embodiment, the first inclined surface 511 and the horizontal flat surface 512 are positioned above the lower surface 211*a* of the hole 211 when the door 400 is open. Therefore, direct abutment of the support shaft 352 onto the lower surface 211*a* can be restrained. Accordingly, frictional wearing of the lower surface 211*a* and the support shaft 352 can be avoided to enable stabilized image forming operation for a prolonged period. On the other hand, the first inclined surface 511, the horizontal flat surface 512 and the protruding part 513 are retracted to a position lower than the lower surface 211*a* when the door 400 is closed. Therefore, abutment between the support shaft 352 and the lower surface 211*a* can be provided, so that the image forming unit 350 can be subjected to positioning at a given position within the frame 200. In this case, since the support shaft 352 is pressed by the third inclined surface 517, stabilized positioning can be made. Accordingly, performance of image forming operation can be further ensured.

Further, the first inclined surface 511, the horizontal flat surface 512 and the protruding part 513 those preventing the support shaft 352 from directly abutting on the lower surface 211*a* are provided integrally with the locking member 500 having the locking hook 520 that maintains the door 400 in its closed position. Accordingly, a simplified construction can be provided eliminating mechanical parts and components, thereby lowering production cost. Further, positioning of the image forming unit 350 is attained by the engagement between the support shaft 352 and the lower surface 211*a* of the hole 211 formed in the metal frame 200 and, the third inclined surface 517 directly presses the support shaft 352. Accordingly, sufficient positioning of the image forming unit 350 relative to the frame 200 is achievable. Thus, the resultant laser printer 100 can produce accurate visible image on the sheet P.

Further, various modifications are conceivable.

For example, the present invention can be applied to several types of an image forming device, such as, a monochromatic laser printer, a facsimile machine, an ink jet printer, and a copying machine. Further, in the above described embodiment, the image forming unit 350 is detachable from the main frame 200. However, the present invention is not only available for the image forming unit of complete detachment type but also for an image forming unit of non-detachable type. In the latter case, the image forming unit can be pulled out and inserted into the main frame without any detachment from the main frame. For example, the image forming unit 350 can be pulled out of the main frame 200 to the extent that each of the developing cartridges 324 is exchangeable.

Further, in the image forming unit 350 of the above-described embodiment, the developing cartridges 324 and the photosensitive drums 321 are assembled in a single process cartridge unit. However, a cartridge including only the developing cartridge is also available in the present invention.

Further, the pressure portion (the third inclined surface 517) can press any part of the image forming unit other than the support shaft 352. However, direct pressure applied by the third inclined surface 517 against the support shaft 352 can provide accurate positioning of the image forming unit 350 with respect to the main frame 200.

Further, in the above-described embodiment, the lock member 500 is engaged with the support shaft 352 for positioning the image forming unit 350. However, the lock member 500 can be engaged with a part or component of the image forming unit 350 other than the support shaft 352. Still however, as long as the locking member 500 made from a resin is provided where the engagement surface of the locking member 500 is moved upward exceeding the lower surface 211*a* in response to the opening stroke of the door 400 in order to protect the lower surface 211*a*, the support shaft 352 would be a desirable component to be brought into abutment with the engagement surface.

Moreover, frictional wearing of the support shaft 352 can be efficiently reduced because the locking member 500 is made from the resin. Consequently, frictional abrasion of the lower surface 211*a* and the support shaft 352 can further be reduced to provide desirable image forming operation for a prolonged period of time.

Further, the above-described embodiment pertains to the direct transfer tandem type color image forming system where the sheet P is conveyed by the conveying belt 313 so as to sequentially pass through the photosensitive drums 321 for directly receiving toner images from the photosensitive drums 321 onto the sheet P. However, the present invention is also available for an intermediate transfer tandem type color image forming system where the toner images formed on the photosensitive drums 321 are transferred onto an intermediate transfer belt, and then, the toner images transferred onto the intermediate transfer belt are transferred onto the sheet P.

While the invention has been described in detail and with reference to specific embodiment thereof, it would be apparent to those skilled in the art that various changes and modifications can be made within the scope and spirit of the invention.

What is claimed is:

1. An image forming device comprising:

a frame having a pair of metal frames providing lateral side panels, each metal frame having an end face functioning as a first positioning part;

an image forming unit detachably supported to the frame and having a support shaft engageable with the end face and functioning as a second positioning part abuttable on the first positioning part for positioning the image forming unit relative to the frame;

a door movable between an open position and a closed position relative to the frame, the image forming unit being detachable from or attachable to the frame at the open position, a lock unit lockingly engageable with the door at the closed position of the door for maintaining the closed position, the lock unit being supported to the metal frame and movable between an upper position and a lower position at which the door is locked;

a pressure portion provided at the lock unit and configured to urge the image forming unit so as to press the second positioning part onto the first positioning part at the closed position of the door, the pressure portion urging the support shaft toward the end face; and a cam member having a cam surface with which the lock unit is in contact, the cam surface being configured to move the lock unit toward the upper position in response to the movement of the door to the open position and to move the lock unit toward the lower position in response to the movement of the door to the closed position, the pressure portion being positioned above the end face and being movable toward the end face as a result of the movement of the lock unit toward the lower position, whereby the support shaft is pressed between the pressure portion and the end face in response to the movement of the door to the closed position.

2. The image forming device as claimed in claim 1, wherein the pressure portion is integral with the lock unit.

3. The image forming device as claimed in claim 1, wherein the cam member is movable in interlocking relation to the movement of the door.

4. The image forming device as claimed in claim 3, wherein the cam member is pivotally movably supported to the frame and connected to the door.

5. An image forming device comprising:

a frame having a first positioning part;

an image forming unit detachably supported to the frame, the image forming unit having a second positioning part abuttable on the first positioning part for positioning the image forming unit relative to the frame and an image bearing member bearing an image of a developing agent;

a door movable between an open position and a closed position relative to the frame, the image forming unit being detachable from or attachable to the frame at the open position;

a lock unit lockingly engageable with the door at the closed position of the door for maintaining the closed position; the lock unit being movable to an upper position in response to the movement of the door toward the open position;

a pressure portion provided at the lock unit and configured to urge the image forming unit so as to press the second positioning part onto the first positioning part at the closed position of the door;

a conveyer unit that conveys an image recording medium and disposed in the frame; and a shift portion provided at the lock unit and movable in association with the upward movement of the lock unit for urging the image forming unit in a direction so that the image bearing member moves away from the conveyer unit in response to the movement of the door to the open position.

6. The image forming device as claimed in claim 5, wherein the shift portion is integral with the lock unit.

7. The image forming device as claimed in claim 5, wherein the frame comprises a pair of metal frames providing lateral side panels, each metal frame having an end face functioning as the first positioning part; and wherein the image forming unit has a support shaft engageable with the end face and functioning as the second positioning part, the pressure portion urging the support shaft toward the end face.

8. The image forming device as claimed in claim 7, wherein the lock unit is supported to the metal frame and movable between an upper position and a lower position at which the door is locked; and the image forming device further comprising a cam member having a cam surface with which the lock unit is in contact, the cam surface being configured to move the lock unit toward the upper position in response to the movement of the door to the open position and to move the lock unit toward the lower position in response to the movement of the door to the closed position, the shift portion exceeding the end face as a result of the movement of the lock unit toward the upper position, whereby the support shaft having been mounted on the end face can be transferred onto the shift portion.

9. The image forming device as claimed in claim 8, wherein the cam member is movable in interlocking relation to the movement of the door.

10. The image forming device as claimed in claim 5, further comprising a second shift portion provided at the frame at a position close to the first positioning part for pressing the second positioning part in association with the upward movement of the lock unit thereby urging the image forming unit frontward in response to the movement of the door to the open position.

11. The image forming device as claimed in claim 5, wherein the pressure portion is integral with the lock unit.

* * * * *

UNITED STATES PATENT AND TRADEMARK OFFICE

CERTIFICATE OF CORRECTION

PATENT NO. : 8,160,472 B2
APPLICATION NO. : 12/405719
DATED : April 17, 2012
INVENTOR(S) : Yoshiya Tomatsu It is certified that error appears in the above-identified patent and that said Letters Patent is hereby corrected as shown below:

Title Page, Item (73) Assignee Should Read:

-- Brother Kogyo Kabushiki Kaisha, Aichi-ken (JP) --

Signed and Sealed this
Third Day of July, 2012

David J. Kappos

David J. Kappos
*Director of the United States Patent and Trademark Office*